US007837422B2

(12) United States Patent
Lien

(10) Patent No.: US 7,837,422 B2
(45) Date of Patent: Nov. 23, 2010

(54) METHOD OF BINDING SHEET STACK HAVING MOUNTING HOLE

(76) Inventor: Chin-Hsiung Lien, 11561 Hallword Dr., El Monte, CA (US) 91732

( * ) Notice: Subject to any disclaimer, the term of this patent is extended or adjusted under 35 U.S.C. 154(b) by 0 days.

(21) Appl. No.: 12/655,785

(22) Filed: Jan. 6, 2010

(65) Prior Publication Data

US 2010/0111644 A1 May 6, 2010

Related U.S. Application Data

(62) Division of application No. 11/906,911, filed on Oct. 3, 2007, now Pat. No. 7,670,075.

(51) Int. Cl.
*B42C 9/00* (2006.01)

(52) U.S. Cl. ..... 412/6

(58) Field of Classification Search ..... 412/6; 402/8, 13–16, 47, 48; 281/2, 5, 21.1, 27.1, 281/27.2, 27.3, 28; 24/703.3, 705.5; 40/658
See application file for complete search history.

(56) References Cited

U.S. PATENT DOCUMENTS 1,257,631 A * 2/1918 Nielsen et al. ..... 402/15
1,466,347 A * 8/1923 Washburne ..... 24/703.3
2,609,580 A * 9/1952 Dixon ..... 402/14
4,749,427 A * 6/1988 Pitts et al. ..... 156/212

* cited by examiner

*Primary Examiner*—Dana Ross
*Assistant Examiner*—Matthew G Katcoff
(74) *Attorney, Agent, or Firm*—Raymond Y. Chan; David and Raymond Patent Firm

(57) ABSTRACT

A method of binding a sheet stack having a mounting hole includes the steps of: slidably inserting two fastening arms into the mounting hole of the sheet stack at a top side thereof until a first binding portion of a binding body is biased against the top side of the sheet stack at an edge portion thereof; adjustably bending a second binding portion of the binding body to bias against a bottom side of the sheet stack at the edge portion thereof with respect to a thickness of the sheet stack; aligning an elongated guiding slot of the binding body with the mounting slot; and bending the fastening arms for resting on the bottom side of the sheet stack to reinforce the edge portion of the sheet stack being securely sandwiched between the first and second binding portions of the binding body.

20 Claims, 12 Drawing Sheets

METHOD OF BINDING SHEET STACK HAVING MOUNTING HOLE

CROSS REFERENCE OF RELATED APPLICATION

This is a Divisional application of a non-provisional application having an application Ser. No. 11/906,911 and a filing date of Oct. 3, 2007 now U.S. Pat. No. 7,670,075.

BACKGROUND OF THE PRESENT INVENTION

1. Field of Invention

The present invention relates to a paper binder, and more particularly to a method of binding sheet stack having mounting hole, wherein the binder unit provides a one-piece structure to securely hold the edge portion of the bundle of sheets through the holes thereof.

2. Description of Related Arts

A paper binder is considered as one of the common tools to hold several sheets of paper together. It is usually commonly used in office. People widely uses in its small, light, quick, and easily removed. Accordingly, there are two major types of conventional paper binder, which are hole-punching type and non-hole-punching type.

The non-hole-punching type of paper binder consists of paper clip, binder clip, and staples for holding bounce of paper together without punching any hole on the paper. The paper clip is a device which holds several sheets of paper together by means of pressure. It leaves the paper intact and can be quickly and easily removed. However, the paper clips must be configured in different sizes to fit the corresponding thickness of the paper stack. In other words, when more sheets of paper are gradually accumulated to increase the thickness of the paper stack, the user must change a bigger size of paper clip to hold the paper stack tightly.

Furthermore, the paper clip is a thin wire bent into a looped shape that takes advantage of the elasticity and strength of the material of its construction. However, the paper clip is extremely easy to be deformed its shape to loss the clip ability of the paper clip. In other words, the paper clip is a good tool for the user to temporary hold the paper together, but it is not a secure way to put our important document together.

The binder clip is commonly used in the modern office, and is also a simple device for binding a few to many sheets of paper. In the same way, it leaves the paper intact and can be quickly and easily removed. As compared to a paper clip, the binder clip is able to bind sheets of paper more securely, and is also resistant to rust. But there are still several sizes of binder clips to meet the customers need in responsive to the thickness of the paper stack. Moreover, owing to the arm of force of the binder clip is usually small, people often need to apply huge force to allow the clip to be open. Furthermore, if there are only few sheets of paper for being held together, the binder clip is not usually function well. Thus, the size of the binder clip is relatively large that the binder clip will normally take the whole corner portion of the paper stack.

The staple is another way to hold a bunch of paper together. The legs of the stable are penetrated through the paper stack to the back side thereof and are folded over to provide greater binding that the friction of straight legs. It keeps the advantages of easily operating and secure. However, the staple will damage the paper stack especially when the staple is removed from the paper stack. Thus, the staple cannot be re-used.

The hole-punching type of paper binder requires two or more spaced apart holes punched on each of the paper to form a punching hole such that when the papers are stacked, the punching holes of the papers are aligned to form two spaced apart mounting holes for the paper binder binding thereat. Accordingly, such paper binder can securely hold the paper stack in position through the mounting hole especially for lots of papers stacking together. The paper binder generally comprises a base clip with two flexible arms extending through the mounting holes from the back side of the paper stack and a front clip coupling with the flexible arms at the front side of the paper stack. However, each of the punching holes of the paper is extremely easy to be damaged because the flexible arm may cut at the circumferential edge of the punching hole during binding operation. Thus, some hole-punching type of paper binders require two mounting holes to bind the papers while some hole-punching type of paper binders require three mounting hole to bind the papers. However, the particular configuration of the paper binder can only work with either the two-hole paper or the three-hole paper only.

Accordingly, the major drawback of the hole-punching type of paper binder is that once the papers are bound together, the user must take out the whole stack of papers to select the particular sheet of paper. In other words, when the user take out the whole stack of papers from the paper binder, the punching holes of the papers are not aligned anymore. Therefore, after the user takes the particular sheet of paper from the paper stack, he or she must align the punching holes of the papers again for the flexible arm passing therethrough. As it is mentioned above, the flexible arm may cut at the circumferential edge of the punching hole during binding operation.

SUMMARY OF THE PRESENT INVENTION

A main object of the present invention is to provide a binder unit for binding a stack sheet, wherein the binder unit provides a one-piece structure to securely hold the edge portion of the bundle of sheets through the holes thereof.

Another object of the present invention is to provide a binder unit, wherein the binder unit comprises a binding body bent in U-shape that first and second binding portions of the binding body are biased against the top and bottom sides of the stack sheet at the edge portion thereof so as to securely hold the stack sheet via the binding body.

Another object of the present invention is to provide a binder unit, wherein the binder unit is adjustably bent to fit the thickness of the stack sheet such that the user is able to adjust the distance between the first and second binding portion by re-bending the binding body when additional sheets are added into the stack sheet to increase the thickness thereof.

Another object of the present invention is to provide a binder unit, wherein the two fastening arms of the binder unit are extended from the first binding portion to detachably couple with the second binding portion through the mounting hole such that binder unit is adapted to securely bind the sheets together unless the fastening arms are intentionally slid out of the mounting hole.

Another object of the present invention is to provide a binder unit, wherein the surrounding edge portion of the mounting hole of the stack sheet is protected by the edge protecting portion of the binding body so as to prevent the damage of the mounting hole.

Another object of the present invention is to provide a binder unit, wherein the fastening arms are extended along an inner circumference of the mounting hole to reinforce a strength of the stack sheet at the mounting hole thereof.

Another object of the present invention is to provide a binder unit, which is adapted to incorporate with an existing binder such that the binder unit of the present invention can be used as an organizer to organize different stacks of sheets in the existing binder.

Another object of the present invention is to provide a binder unit, which does not require altering the original structural design of the sheet such as filler paper, so as to minimize the manufacturing cost of the binder unit incorporating with the sheet having a binding hole thereon. In other words, the binder unit of the present invention can be used for the filler paper with one binding hole, two binding holes or three binding holes.

Another object of the present invention is to provide a binder unit, wherein no expensive or complicated structure is required to employ in the present invention in order to achieve the above mentioned objects. Therefore, the present invention successfully provides an economic and efficient solution for providing a securely binding configuration for the stack sheet.

Accordingly, in order to accomplish the above objects, the present invention provides a binder unit for binding a sheet stack having a mounting hole, comprising an elongated binding body and two spaced apart fastening arms.

The binding body, which is made of bendable material, has a first binding portion defining a first edge, a second binding portion defining an opposed second edge, and an elongated guiding slot longitudinally extended along the second binding portion, wherein the binding body is adjustably bent in a U-shaped structure with respect to a thickness of the sheet stack, such that the first binding portion of the binding body is arranged for biasing against a top side of the sheet stack at an edge portion thereof while the second binding portion of the binding body is arranged for biasing against a bottom side of the sheet stack at the edge portion thereof to align the guiding slot with the mounting hole.

The fastening arms are extended from the first edge of the binding body to detachably engage with the second binding portion of the binding body at a position that the fastening arms are slidably coupled within the guiding slot through the mounting hole of the sheet stack, wherein the fastening arms are bent for resting on the bottom side of the sheet stack to reinforce the edge portion of the sheet stack being securely sandwiched between the first and second binding portions of the binding body.

These and other objectives, features, and advantages of the present invention will become apparent from the following detailed description, the accompanying drawings, and the appended claims.

DETAILED DESCRIPTION OF THE PREFERRED EMBODIMENT

Figure 1:
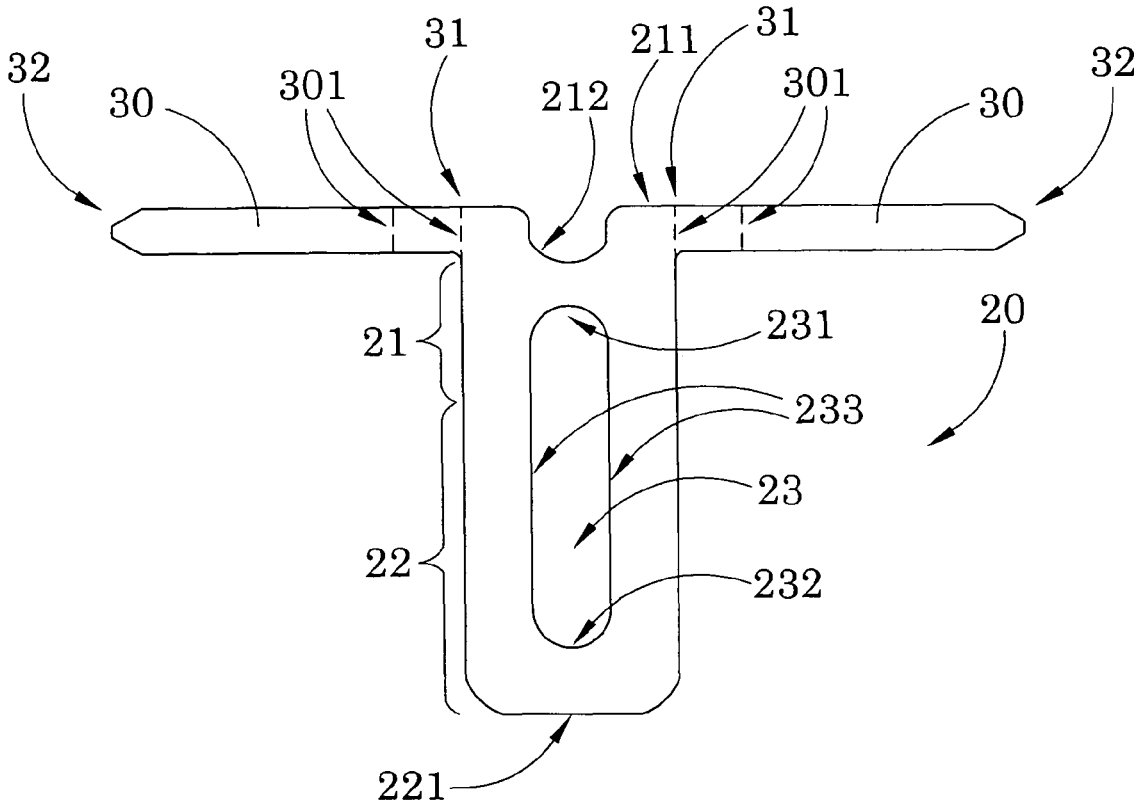
FIG. 1 is a schematic view of a binder unit according to a first preferred embodiment of the present invention.
Figure 2A:
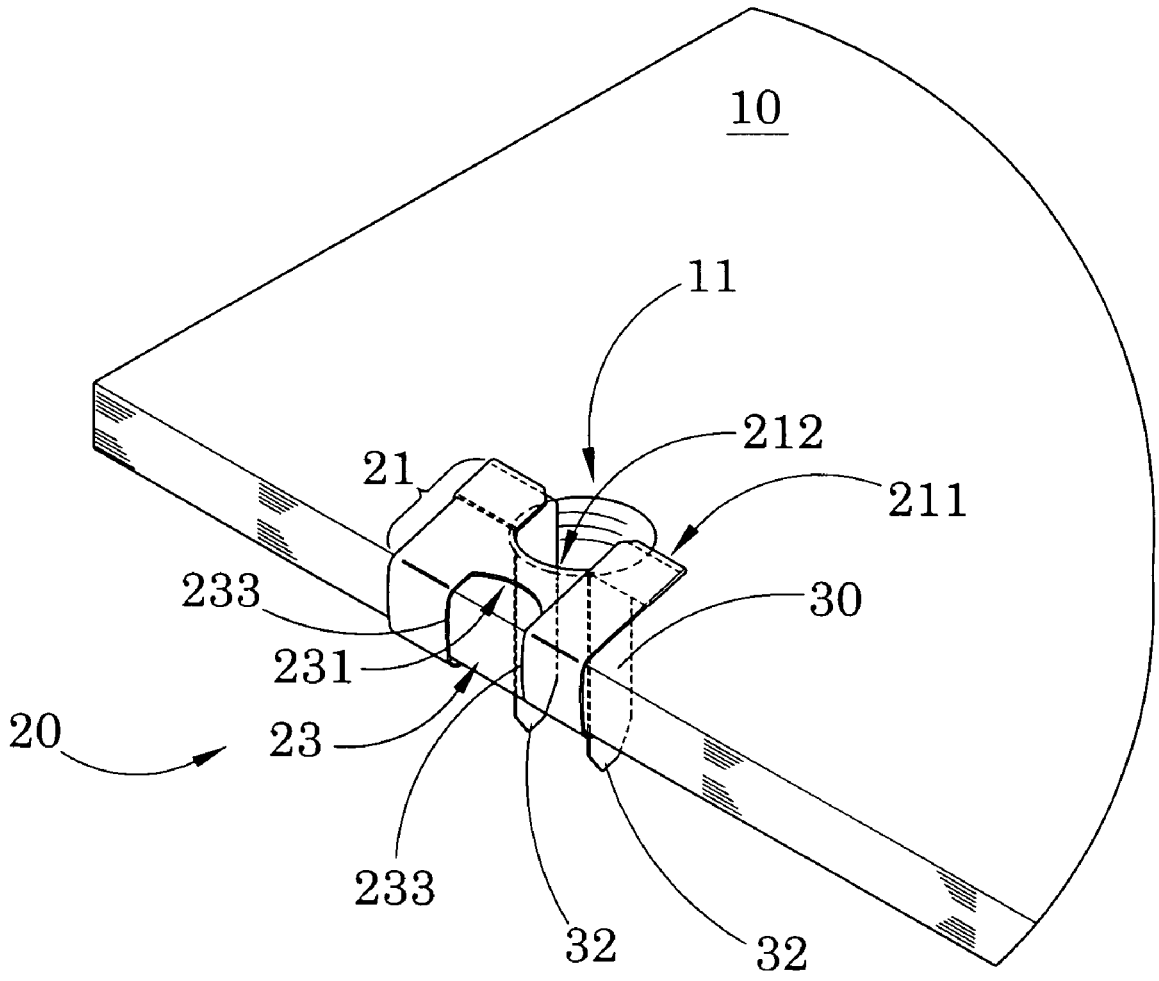
FIGS. 2A and 2B are perspective views of the binder unit binding to a stack sheet according to the above first preferred embodiment of the present invention, illustrating the binder unit binding at the end portion of the stack sheet.
Figure 2B:
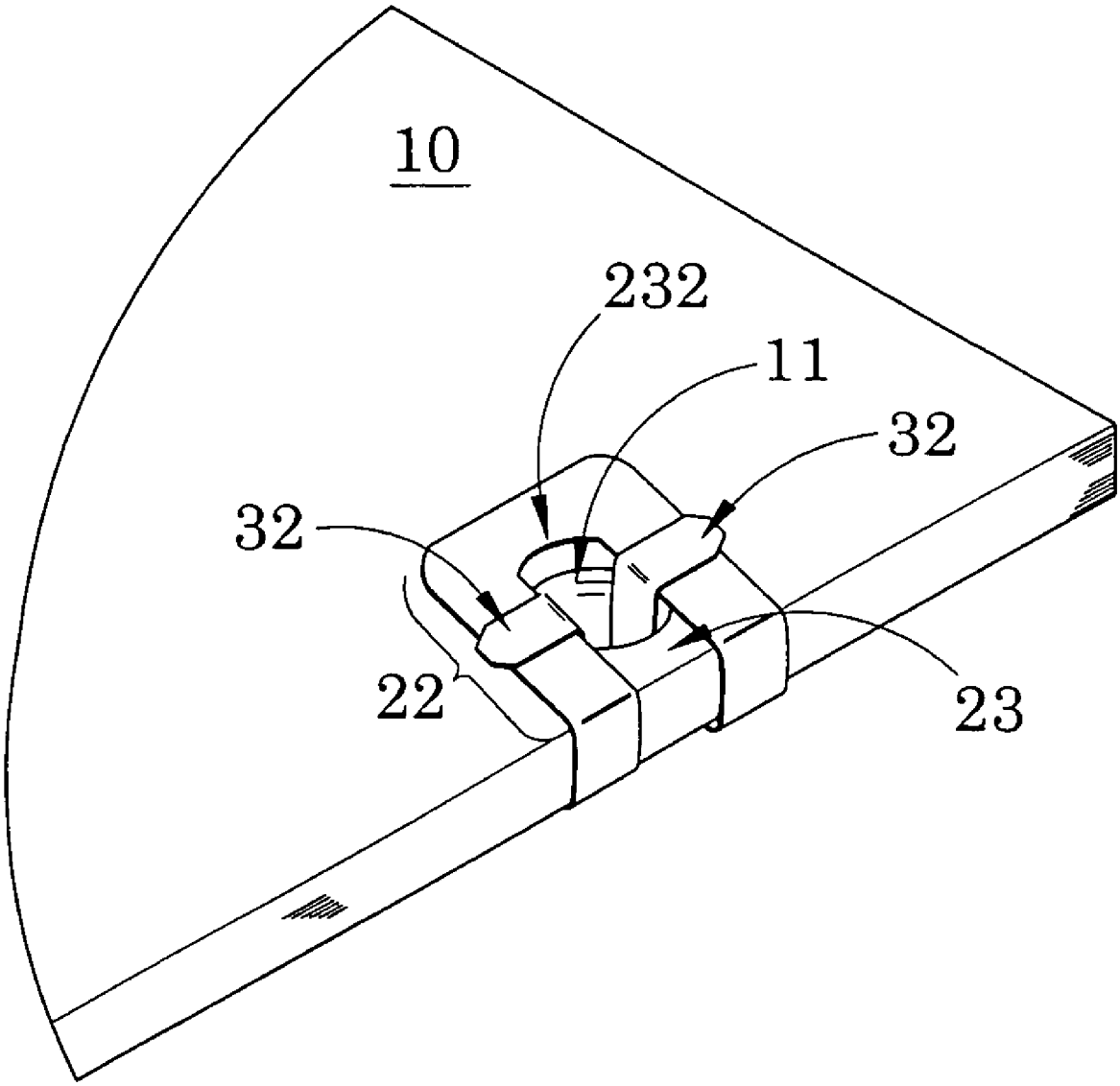
Figure 3:
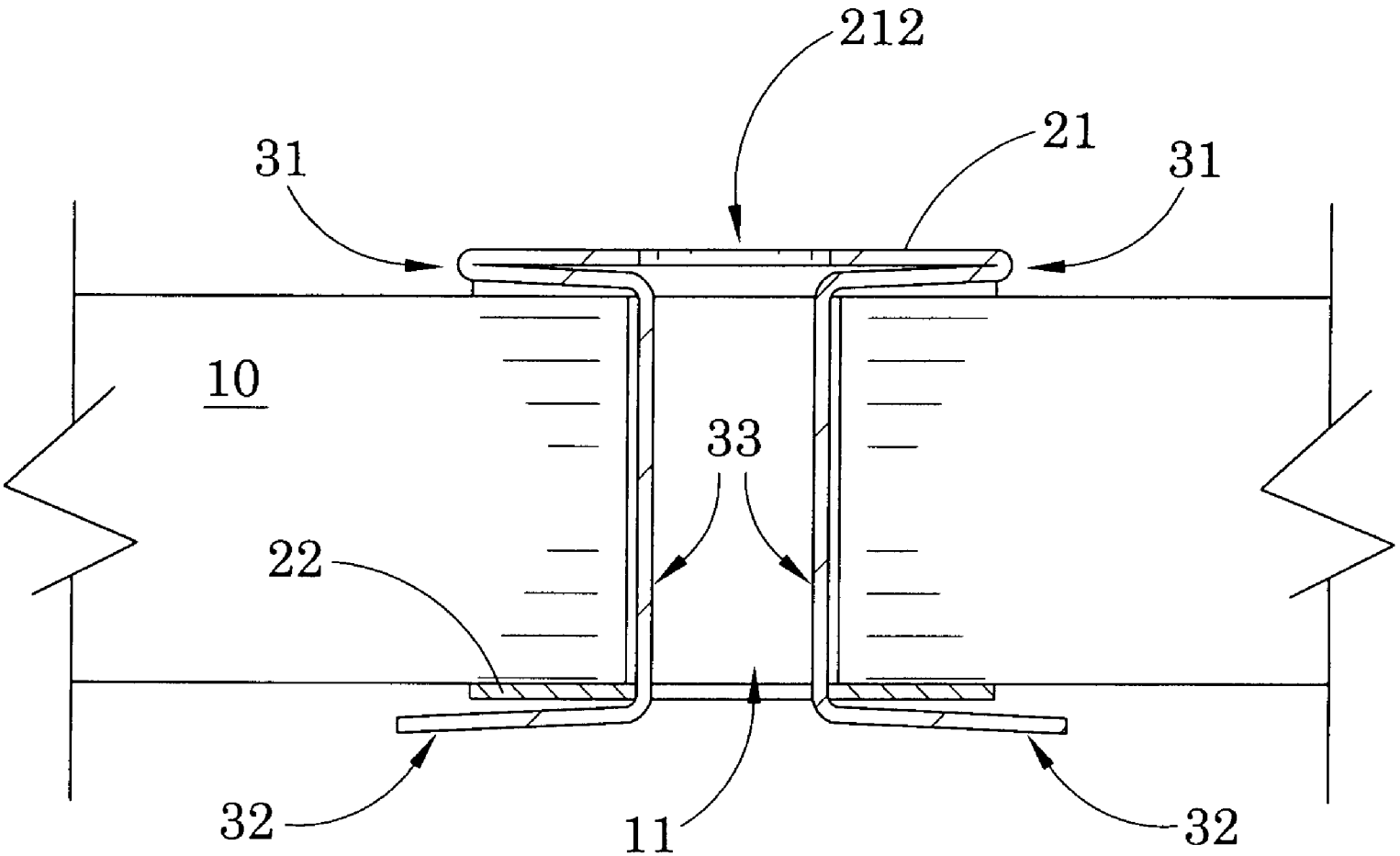
FIG. 3 is a sectional view of the binder unit binding to the stack sheet according to the above first preferred embodiment of the present invention.

Referring to FIGS. 1, 2A and 2B of the drawings, a binder unit according to a preferred embodiment of the present invention is illustrated, wherein the binder unit, which is adapted for binding a sheet stack 10 having a mounting hole 11, comprises an elongated binding body 20 and two spaced apart fastening arms 30.

The binding body 20, which is made of bendable material, has a first binding portion 21 defining a first edge 211, a second binding portion 22 defining an opposed second edge 221, and an elongated guiding slot 23 longitudinally extended along the second binding portion 22.

Accordingly, the binding body 20 is adjustably bent in a U-shaped structure with respect to a thickness of the sheet stack 10, such that the first binding portion 21 of the binding body 20 is arranged for biasing against a top side of the sheet stack 10 at an edge portion thereof while the second binding portion 22 of the binding body 20 is arranged for biasing against a bottom side of the sheet stack 10 at the edge portion thereof to align the guiding slot 23 with the mounting hole 11 so as to securely hold the stack sheet 10 via the binding body 20. It is worth to mention that the binding body 20 of the binder unit is adjustably bent to fit the thickness of the stack sheet 10 such that the user is able to adjust the distance between the first and second binding portions 21, 22 by re-bending the binding body 10 when additional sheets are added into the stack sheet 20 to increase the thickness thereof. In other words, compared to the conventional binder, the binder unit of the present invention is more flexible for different thickness stacks of sheets.

According to the preferred embodiment, the two fastening arms 30 are spacedly extended from the first edge 211 of the binding body 20 to detachably engage with the second binding portion 22 of the binding body 20 at a position that the fastening arms 30 are slidably coupled within the guiding slot 23 through the mounting hole 11 of the sheet stack 10, wherein the fastening arms 30 are bent for resting on the bottom side of the sheet stack 10 to reinforce the edge portion of the sheet stack 10 being securely sandwiched between the first and second binding portions 21, 22 of the binding body 20.

As shown in FIGS. 1 and 2A, the first edge 211 of the binding body 20 has an edge protecting portion 212 defined between the fastening arms 30, wherein the edge protecting portion 212 of the binding body 20 has a predetermined curvature corresponding to a curvature of the mounting hole 11, such that when the first binding portion 21 of the binding body 20 biases against the top side of the sheet stack 10, the edge protecting portion 212 of the binding body 20 is aligned with a surrounding edge portion of the mounting hole 11 as shown in FIG. 2A. It is worth to mention that because the edge protection portion 212 is perfect fit the corresponding mounting hole, the surrounding edge portion of the mounting hole 11 of the stack sheet 10 is protected by the edge protection portion 212 of the binding body 20 so as to prevent the damage of the mounting hole 11 by any tearing force.

Accordingly, the guiding slot 23 has a first closed end 231 extended towards the first edge 211 of the binding body 20, a second closed end 232 extended close to the second edge 221 of the binding body 20, and two parallel guiding edges 233 extended from the first closed end 231 to the second closed end 232 for aligning the mounting hole 11 between the guiding edges 233, such that when the fastening arms 30 are extended through the guiding slot 23, the fastening arms 30 are bent at the guiding edges 233 respectively for resting on the bottom side of the stack sheet 10. It is worth to mention that the guiding slot 23 is preferably extended to the first binding portion 21 of the binding body 20 such that a portion of the guiding slot 23 is positioned on the top side of the sheet stack 10 while a portion of the guiding slot 23 is positioned on the bottom side of the sheet stack 10. Therefore, the guiding slot 23 also enhances the bending structure of the binding body 20 for the user to bend to sandwich the end portion of the sheet stack 10 between the first and second binding portions 21, 22 of the binding body 20. In addition, since the mounting hole 11 at the bottom side of the sheet stack 10 is aligned with the guiding slot 23 between the two guiding edges 233 thereof, the surrounding edge portion of the mounting hole 11 can also be protected via the guiding edges 233. It is worth to mention that when the thickness of the sheet stack 10 matches with the length of the guiding slot 23, the second closed end 232 of the guiding slot is aligned with the surrounding edge portion of the mounting hole 11 at the bottom side of the sheet stack 10 to further protect the mounting hole 11. In other words, the binder unit of the present invention is adapted to not only securely hold the thicker sheet stack 10 but also provide maximum protection of the mounting hole 11 of the thicker sheet stack 10.

According to the preferred embodiment, the fastening arms 30 has a root portion 31 extended from the first edge 211 of the binding body 20, a free end portion 32 bent for resting on the bottom side of the sheet stack 10, and a reinforcing portion 33 defining between the root portion 31 and the free end portion 32 for extending along an inner circumference of the mounting hole 11 to reinforce a strength of the stack sheet 10 at the mounting hole 11 thereof. In the same way, the boundary of the reinforcing portion 33 is formed as a protecting area to enhance the strength of the mounting hole 11 to prevent the mounting hole 11 from being damaged.

As shown in FIG. 1, the fastening arms 30 are integrally extended from the first edge 211 of the binding body 20 to form a one piece structure, wherein the binding body 20 is made of metal piece. In other words, the root portions 31 of the fastening arms 30 are integrally extended from the first edge 211 of the binding body 20, wherein the edge protecting portion 212 of the binding body 20 is provided between the root portions 31 of the fastening arms 30.

Accordingly, the first edge 211 of the binding body 20 has a U-shape structure that the edge protecting portion 212 of the binding body 20 is provide at the mid-curving corner of the first edge 211, wherein the fastening arms 30 are transversely and outwardly extended from two outer sides of the first edge 211 of the binding body 20 respectively.

Each of the fastening arms 30 further contains two spaced apart folding lines 301 formed at the root portion 31 to define a folding section between the two folding lines 301, wherein each of the fastening arms 30 is bent and folded along the folding lines 301 at a position that the folding section of each of the fastening arms 30 is overlapped on the first binding portion 21 of the binding body 20, such that the fastening arms 30 are aligned at the inner sides of the first edge 211 of the binding body 20 respectively for slidably passing through the mounting hole 11 of the sheet stack 10.

It is worth to mention that since the fastening arms 30 are transversely and outwardly extended from two outer sides of the first edge 211 of the binding body 20 respectively, the structural configuration of the binder unit of the present invention can be simplified to form a one-piece flat metal piece so as to minimize the manufacturing cost of the binder unit.

Figure 6:
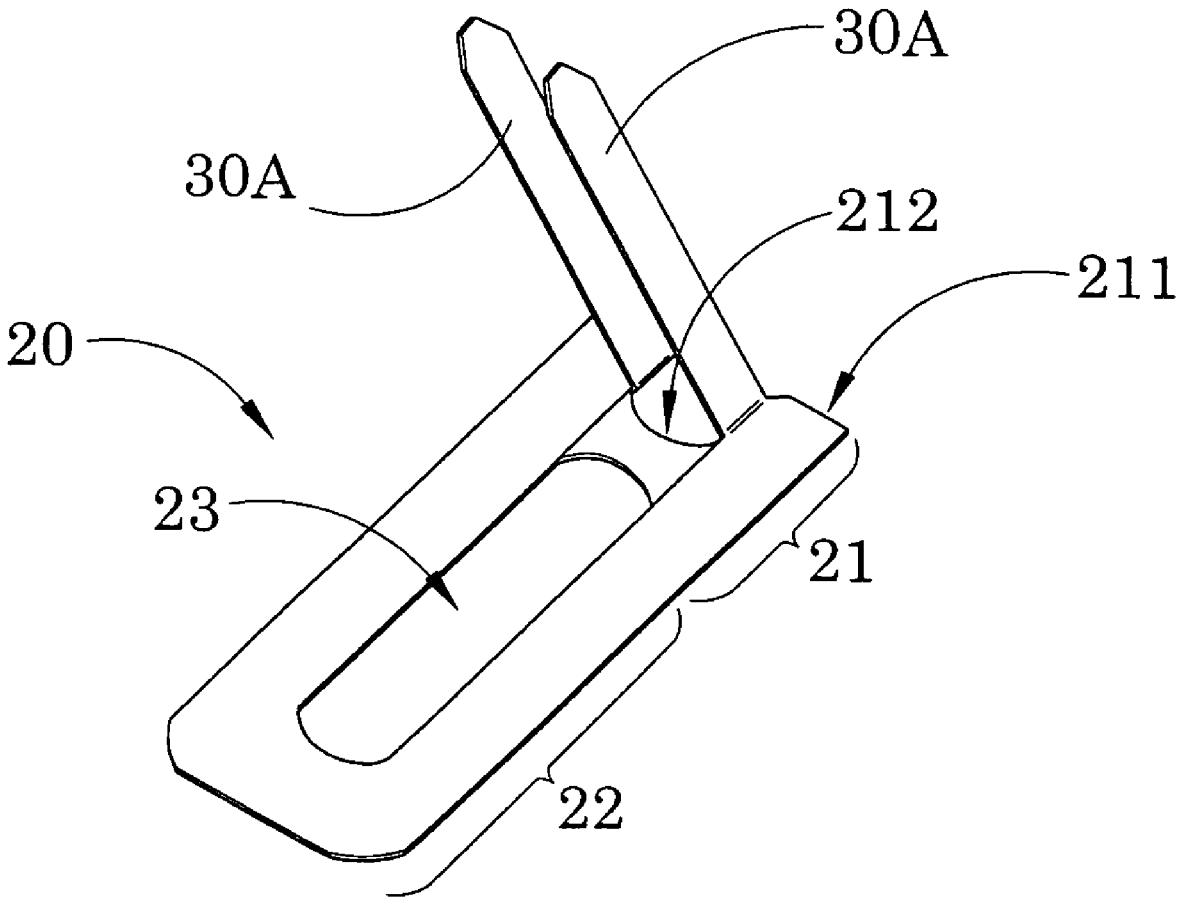
FIG. 6 illustrates an alternative mode of the fastening arm of the binder unit according to the above first preferred embodiment of the present invention.

Alternatively, the first edge 211 of the binding body 20 has a U-shape structure that the edge protecting portion 212 of the binding body 20 is provide at the mid-curving corner of the first edge 211, wherein the fastening arms 30A are transversely and outwardly extended from two inner sides of the first edge 211 of the binding body 20 respectively, as shown in FIG. 6. It is worth to mention that since the fastening arms 30A are transversely and outwardly extended from two inner sides of the first edge 211 of the binding body 20 respectively, the user does not need to fold the fastening arms 30A to the binding body 20 so as to simplify the binding operation of the binder unit.

Figure 4:
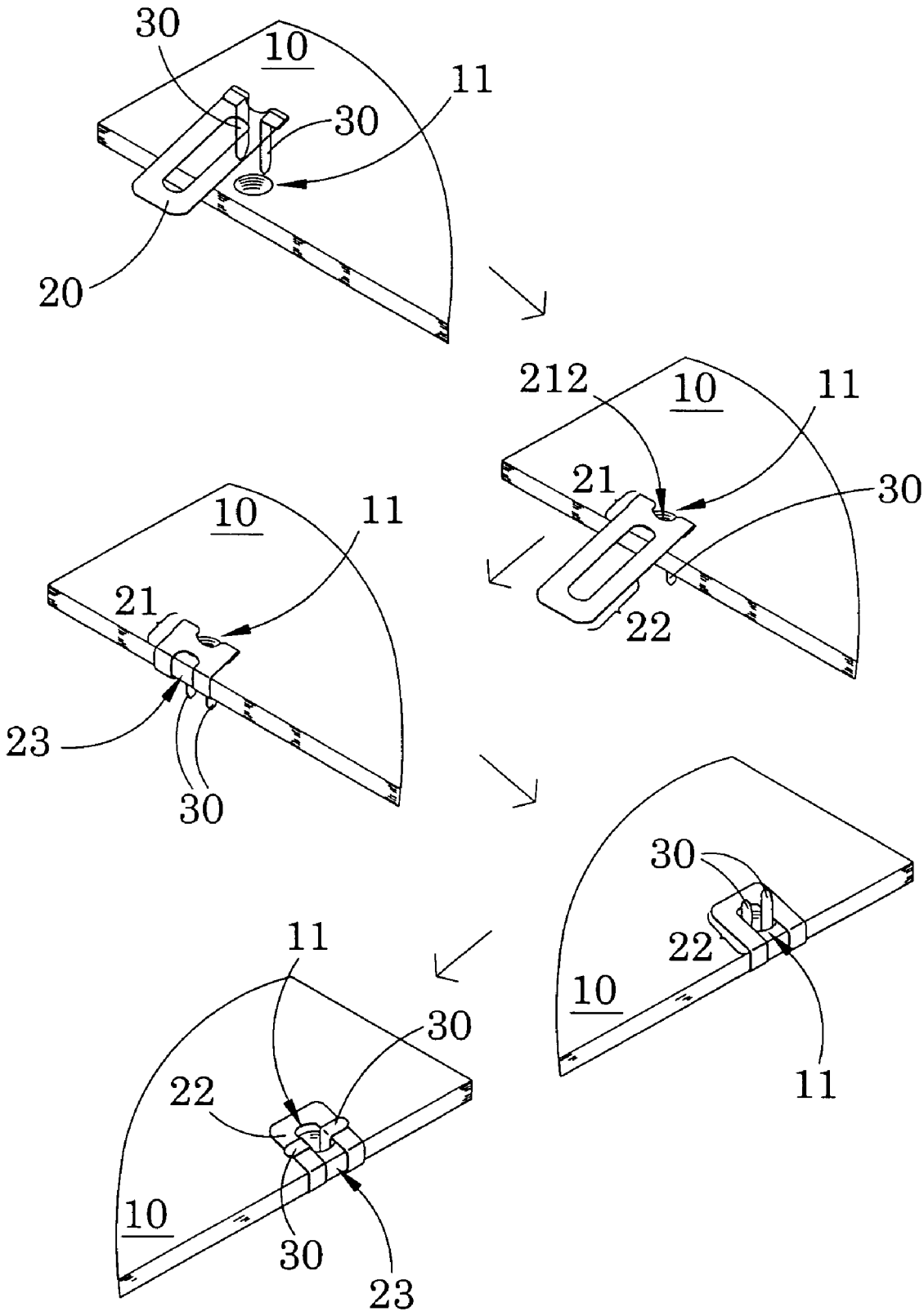
FIG. 4 is a schematic view illustrating the binding operation of the binder unit according to the above first preferred embodiment of the present invention.

As shown in FIG. 4, in order to bind the binder unit to the sheet stack 10, the user is able to stack the sheets to align the punching holes of the sheets to form the mounting hole 11. Then, the user is able to slidably insert the fastening arms 30 into the sheet stack 10 at the top side thereof until the first binding portion 21 of the binding body 20 is biased against a top side of the sheet stack 10 at an edge portion thereof. The second binding portion 22 of the binding body 20 is bent to bias against the bottom side of the sheet stack 10 to sandwich the edge portion of the sheet stack 10 between the first and second binding portions 21, 22 of the binding body 20. It is worth to mention that the second binding portion 22 of the binding body 20 is bent to self-adjust the thickness of the sheet stack 10. At the same time, the fastening arms 30 are slidably passed through the guiding slot 23 at the bottom side of the sheet stack 10. Then, by outwardly bending the fastening arms 30 at the guiding edges 233 of the guiding slot 23 respectively, the fastening arms 30 are rested on the bottom side of the stack sheet 10 to reinforce the edge portion of the sheet stack 10 being securely sandwiched between the first and second binding portions 21, 22 of the binding body 20.

When additional sheets are needed to add to the sheet stack 10, the user is able to bend the fastening arms 30 back to the original configuration, the second binding portion 22 of the binding body 20 is unlocked. Therefore, the user is able to add the additional sheets to the sheet stack 10 and re-bend the second binding portion 22 of the binding body 20 at the bottom side of the sheet stack 10 to adjust the thickness thereof. The fastening arms 30 are then bent to rest on the bottom side of the sheet stack 10 to re-lock the second binding portion 22 of the binding body 20.

Figure 5:
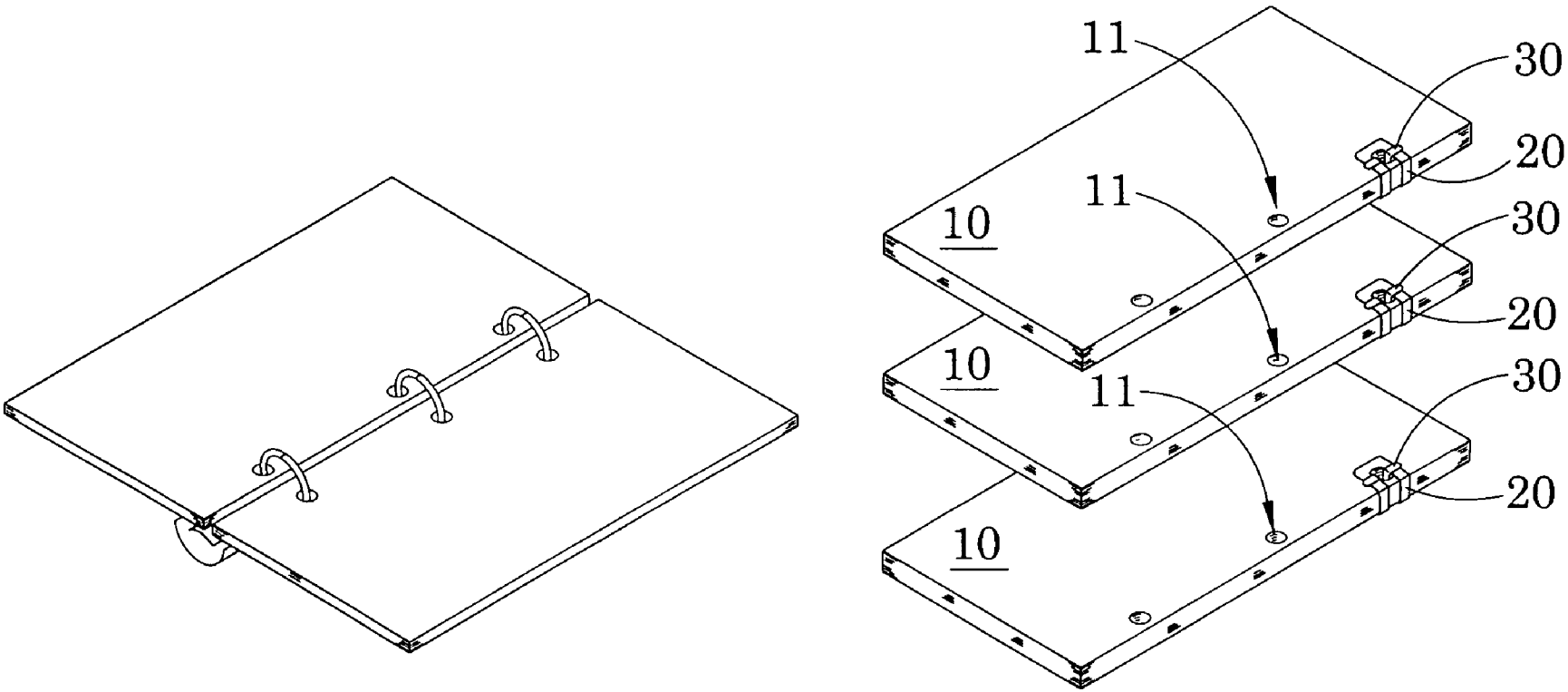
FIG. 5 illustrates the binder unit being used as an organizer to organize different stacks of sheets in the existing binder according to the above first preferred embodiment of the present invention.

As shown in FIG. 5, a binder unit is adapted to incorporate with an existing binder such that the binder unit of the present invention can be used as an organizer to organize different stacks of sheets in the existing binder. In other words, different sheet stacks 10 are organized by the binder units of the present invention and placed in the existing binder. Therefore, the user is able to take the corresponding sheet stack 10 from the existing binder while other sheet stacks 10 are remained in a bound manner. It is worth to mention that the mounting hole 11 of the sheet stack 10 is protected by the edge protecting portion 212 of the binding body 20, the guiding slot 23 of the binding body 20, and the fastening arms 30 at the inner circumference of the mounting hole 11. Therefore, when the sheet stack 10 is placed in the existing binder, the mounting hole 11 will be protected from being damaged via the binder unit of the present invention.

Figure 7:
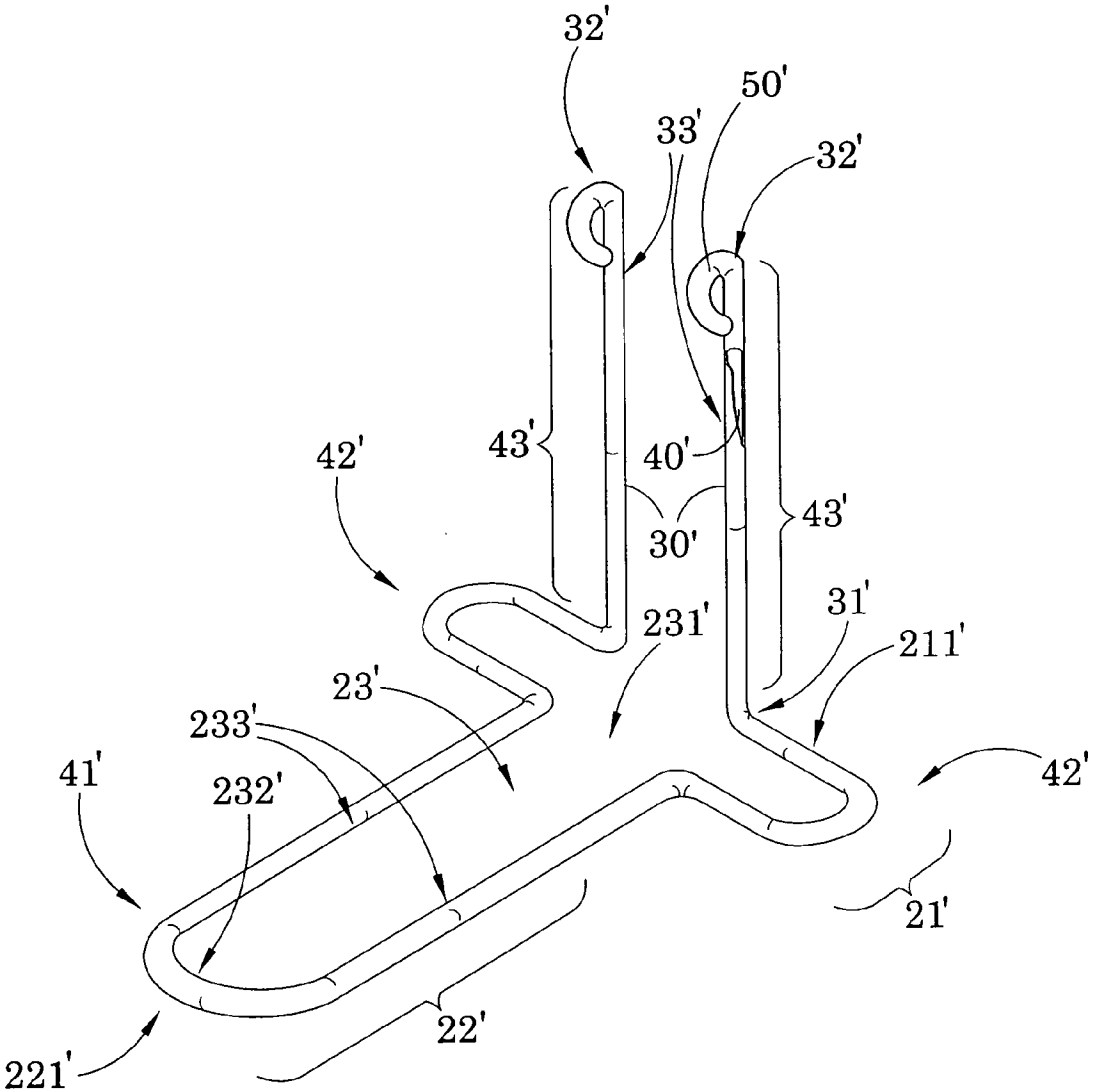
FIG. 7 is a perspective view of a binder unit according to a second preferred embodiment of the present invention.

As shown in FIG. 7, a binder unit of a second embodiment illustrates an alternative mode of the first embodiment of the present invention, wherein the binder unit has the same structural configuration of the first embodiment, except the binder unit is made of an elongated wire.

As shown in FIG. 7, the binding body 20' and the fastening arms 30' are made of an elongated metal wire 40' bent in a U-shape to form a longitudinal U-shaped wire portion 41' as the second binding portion 22' of the binding body 20', two transverse U-shaped wire portions 42' as the first binding portion 21' of the binding body 20', and two free ends 43' as the two fastening arms 30' respectively.

The binder unit of the second embodiment further comprises a plastic tubular sleeve 50' encirclingly enclosing the metal wire 40' for preventing the scratch of the binding body 20' and the fastening arms 30' at the sheet stack 10. In addition, the plastic tubular sleeve 50' can be formed with different colors to enhance the aesthetic appearance of the binder unit.

Accordingly, the first binding portion 21' of the binding body 20' is formed at the two transverse U-shaped wire portions 42' of the metal wire 40' to enhance the contact of the first binding portion 21' of the binding body 20' with the top side of the sheet stack 10.

According to the second embodiment, the guiding slot 23' has a first opened end 231' extended to the first edge 211' of the binding body 20', a second closed end 232' extended close to the second edge 221' of the binding body 20', and two parallel guiding edges 233' formed at the longitudinal U-shaped wire portion of the metal wire, such that when the fastening arms 30' are extended through the guiding slot 23', the fastening arms 30' are bent at the guiding edges 233' respective for resting on the bottom side of the stack sheet 10. Accordingly, a width of the guiding slot 23' matches with a diameter of the mounting hole 11 of the sheet stack 10.

Figure 8:
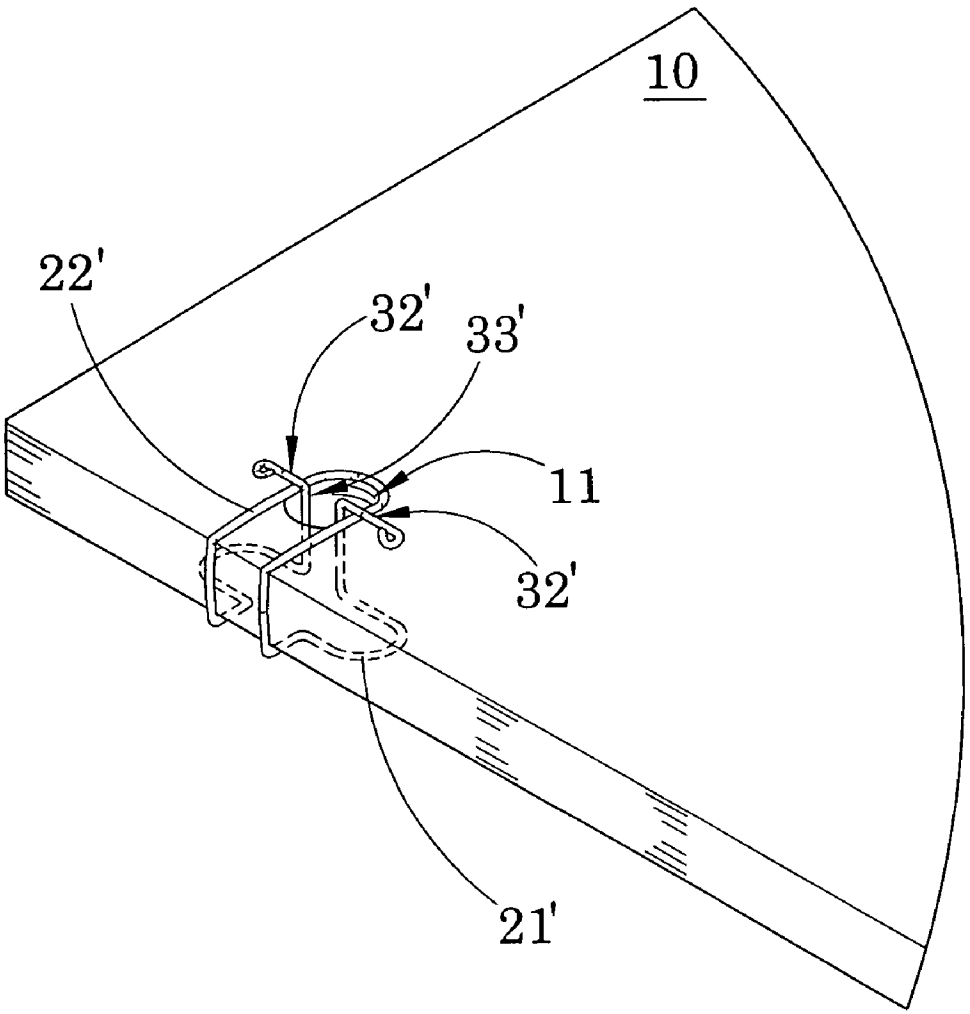
FIG. 8 is a perspective view of the binder unit binding to a stack sheet according to the above second preferred embodiment of the present invention.

Each of the fastening arms 30' has a root portion 31' extended from the first edge 211' of the binding body 20', a free end portion 32' bent for resting on the bottom side of the sheet stack 10, and a reinforcing portion 33' defining between the root portion 31' and the free end portion 32' for extending along an inner circumference of the mounting hole 11 to reinforce a strength of the stack sheet 10 at the mounting hole 11 thereof, as shown in FIG. 8.

As shown in FIG. 7, the free end portion 32' of each of the fastening arms 30' is bent is in loop form for preventing the sheet stack 10 from being scratched and for ease of handling. Accordingly, when the fastening arms 30' are bent on the bottom side of the sheet stack 10, the loop shaped free end portions 32' of the fastening arms 30' are lain on the bottom side of the sheet stack 10. It is worth to mention that the reinforcing portions 33' of the fastening arms 30' are parallely extended through the mounting hole 11 to reinforce a strength of the stack sheet 10.

In addition, the binder unit provides a one-piece structure to securely hold the edge portion of the bundle of sheets through the mounting hole 11 thereof. Therefore, the binder unit of the present invention can be used for different configurations such as three-one-binding-hole configuration, two-binding-hole configuration or three-binding-hole configuration. The binder unit of the present invention only requires one mounting hole 11 to bind the sheet stack 10.

Furthermore, the binder unit of the present invention does not require to alter the original structural design of the sheet such as filler paper, so as to minimize the manufacturing cost of the binder unit incorporating with the sheet having a binding hole thereon. In other words, the binder unit of the present invention can be used for the filler paper with one binding hole, two binding holes or three binding holes.

Moreover, the fastening arms 30, 30' are integrally extended from the first edge 211, 211' of the binding body 20, 20' to form a one piece structure. There is no expensive or complicated structure is required to employ in the present invention in order to achieve the above mentioned objects. Therefore, the present invention successfully provides an economic and efficient solution for providing a securely binding configuration for the stack sheet 10.

Figure 9:
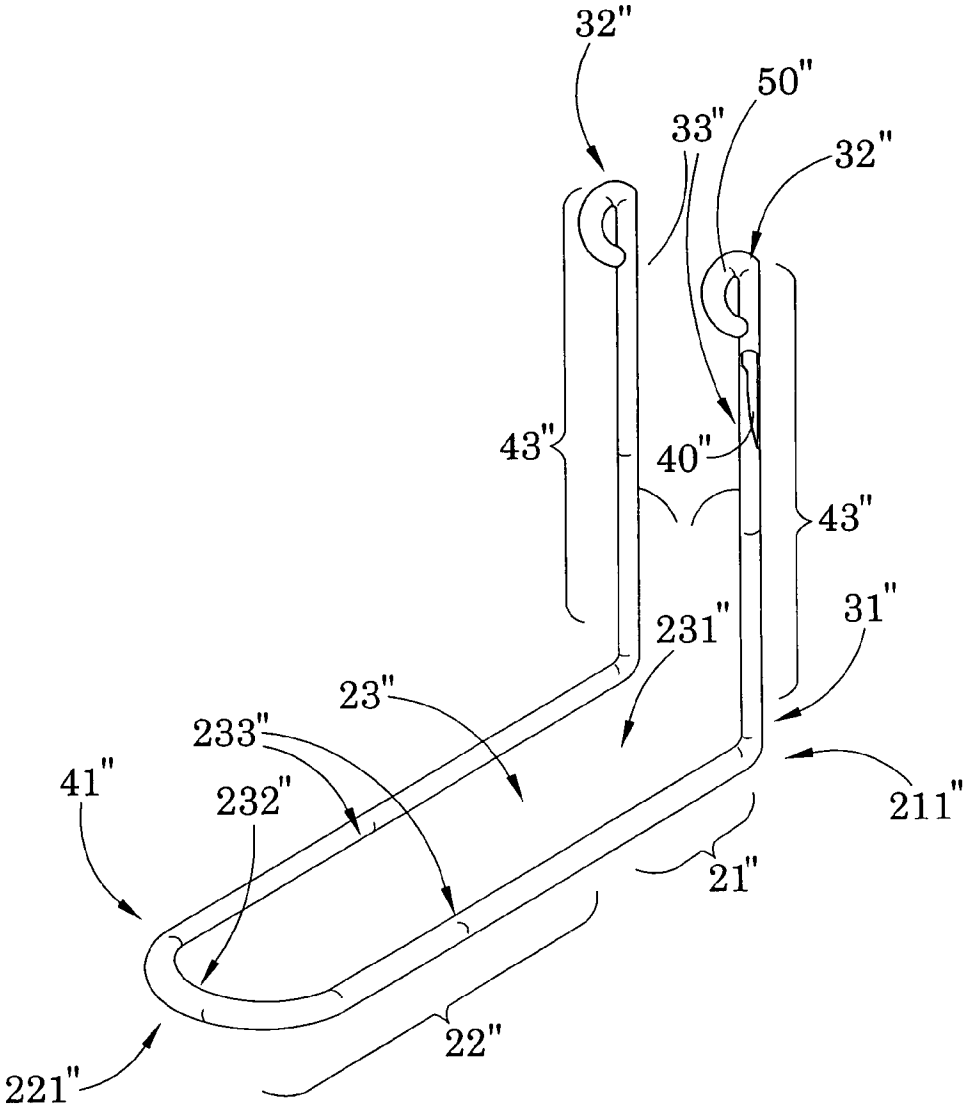
FIG. 9 is a perspective view of a binder unit according to a third preferred embodiment of the present invention.
Figure 10:
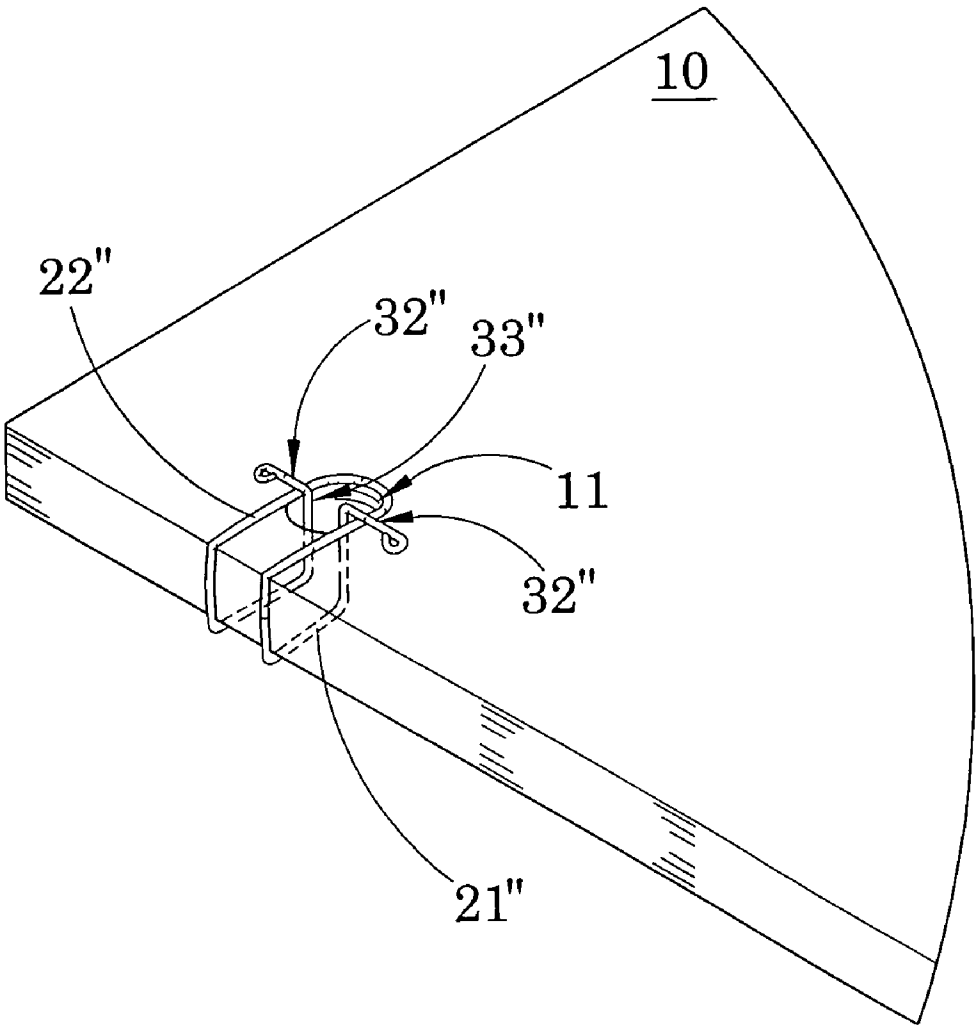
FIG. 10 is a perspective view of the binder unit binding to a stack sheet according to the above third preferred embodiment of the present invention.

As shown in FIGS. 9 and 10, a binder unit of a third embodiment illustrates an alternative mode of the second embodiment of the present invention, wherein the binder unit has the same structural configuration of the second embodiment that the binder unit is also made of an elongated wire.

As shown in FIG. 9, the binding body 20" and the fastening arms 30" are made of an elongated metal wire 40" bent in a U-shape that a U-shaped end portion 41" of the metal wire 40" is formed as the second binding portion 22" of the binding body 20", a mid-portion of the metal wire 40" is formed as the first binding portion 21" of the binding body 20", and two free ends 43" are formed as the two fastening arms 30" respectively.

The binder unit of the third embodiment further comprises a plastic tubular sleeve 50" encirclingly enclosing the metal wire 40" for preventing the scratch of the binding body 20" and the fastening arms 30" at the sheet stack 10. In addition, the plastic tubular sleeve 50" can be formed with different colors to enhance the aesthetic appearance of the binder unit.

According to the second embodiment, the guiding slot 23" has a first opened end 231" extended to the first edge 211" of the binding body 20", a second closed end 232" extended close to the second edge 221" of the binding body 20", and two parallel guiding edges 233" formed at the longitudinal U-shaped wire portion of the metal wire, such that when the fastening arms 30" are extended through the guiding slot 23", the fastening arms 30" are bent at the guiding edges 233" respective for resting on the bottom side of the stack sheet 10. Accordingly, a width of the guiding slot 23" matches with a diameter of the mounting hole 11 of the sheet stack 10.

Each of the fastening arms 30" has a root portion 31" extended from the first edge 211" of the binding body 20", a free end portion 32" bent for resting on the bottom side of the sheet stack 10, and a reinforcing portion 33" defining between the root portion 31" and the free end portion 32" for extending along an inner circumference of the mounting hole 11 to reinforce a strength of the stack sheet 10 at the mounting hole 11 thereof, as shown in FIG. 10. As shown in FIG. 9, the free end portion 32" of each of the fastening arms 30" is bent is in loop form for preventing the sheet stack 10 from being scratched and for ease of handling. Accordingly, when the fastening arms 30" are bent on the bottom side of the sheet stack 10, the loop shaped free end portions 32" of the fastening arms 30" are lain on the bottom side of the sheet stack 10.

Figure 11:
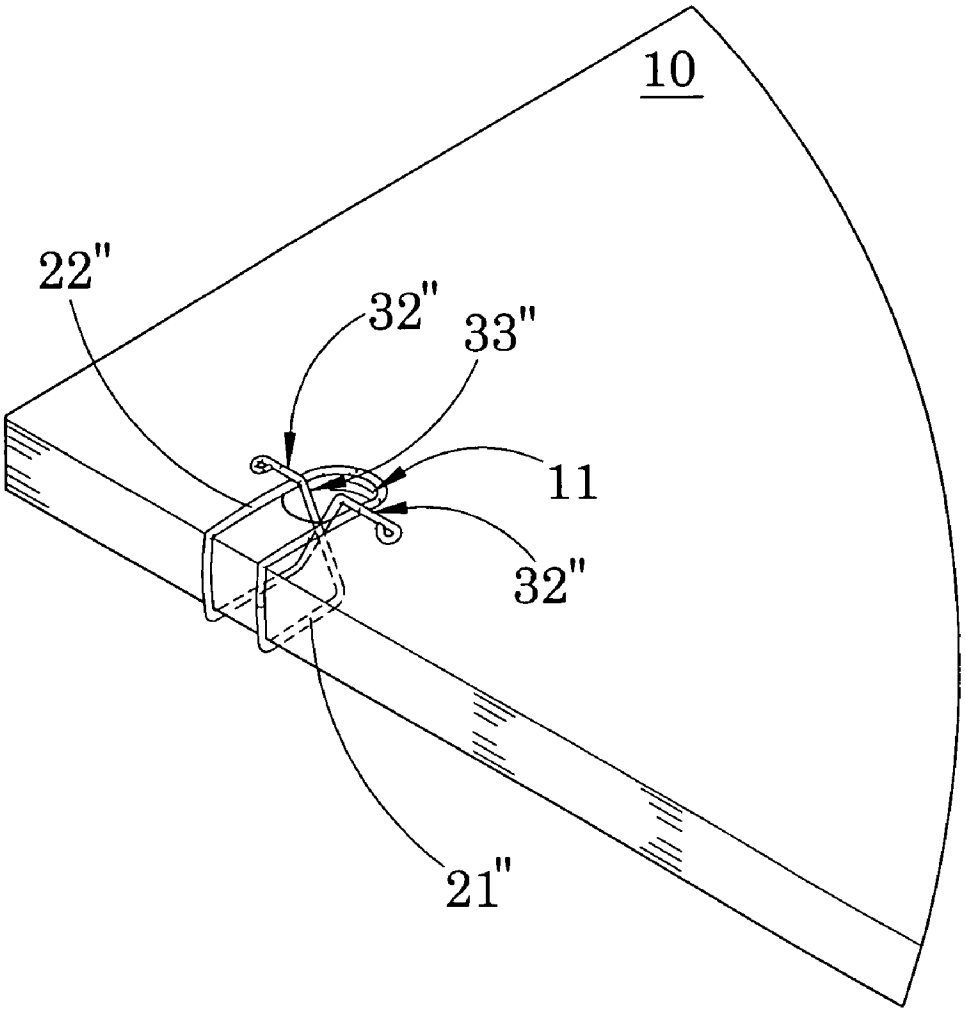
FIG. 11 illustrates an alternative mode of the binder unit according to the above third preferred embodiment of the present invention.

FIG. 11 illustrates an alternative mode of the binder unit according to the third embodiment, wherein the reinforcing portions 33' of the fastening arms 30' are crossed to extend through the mounting hole 11 to reinforce a strength of the stack sheet 10. In other words, the fastening arm 30' at the left side is bent to the right side to press against the bottom side of the sheet stack 10 while the fastening arm 30' at the right side is bent to the left side to press against the bottom side of the sheet stack 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of binding a sheet stack having a mounting hole by a binder unit which comprises an elongated binding body and two fastening arms extended from said binding body, comprising the steps of:

(a) slidably inserting said two fastening arms into said mounting hole of said sheet stack at a top side thereof until a first binding portion of said binding body is biased against said top side of said sheet stack at an edge portion thereof;

(b) adjustably bending a second binding portion of said binding body to bias against a bottom side of said sheet stack at said edge portion thereof, wherein said binding body is adjustably bent in a U-shaped structure with respect to a thickness of said sheet stack;

(c) aligning an elongated guiding slot of said binding body with said mounting hole at said bottom side of said sheet stack when said second binding portion of said binding body is bent to said bottom side of said sheet stack, wherein said guiding slot is longitudinally extended along said second binding portion; and (d) detachably engaging said fastening arms with said second binding portion of said binding body, wherein said fastening arms are bent for resting on said bottom side of said sheet stack to reinforce said edge portion of said sheet stack being securely sandwiched between said first and second binding portions of said binding body.

2. The method, as recited in claim 1, wherein a width of said guiding slot matches with a diameter of said mounting hole of said sheet stack.

3. The method, as recited in claim 1, wherein the step (a) further comprises a step of aligning an edge protecting portion of said binding body with a surrounding edge portion of said mounting hole, wherein said edge protecting portion, having a predetermined curvature corresponding to a curvature of said mounting hole, is provided at said binding body between said fastening arms.

4. The method, as recited in claim 3, wherein a first edge of said binding body has a U-shaped structure and forms said edge protecting portion at a curving corner of said first edge.

5. The method, as recited in claim 4, wherein said fastening arms are transversely and outwardly extended from two inner sides of said first edge of said binding body respectively.

6. The method, as recited in claim 4, wherein said fastening arms are transversely and outwardly extended from two outer sides of said first edge of said binding body respectively.

7. The method, as recited in claim 1, wherein the step (c) further comprises a step of aligning said mounting hole between two guiding edges of said guiding slot such that when said fastening arms are extended through said guiding slot, said fastening arms are bent at said guiding edges respective for resting on said bottom side of said stack sheet.

8. The method, as recited in claim 7, wherein said guiding slot has a first closed end extended towards said first binding portion of said binding body and a second closed end extended to said second binding portion of said binding body that said guiding edges are extended from said first closed end to said second closed end.

9. The method, as recited in claim 1, wherein each of said fastening arms has a root portion extended from said binding body, a free end portion, and a reinforcing portion defining between said root portion and said free end portion, wherein the step (a) further comprises the steps of extending a reinforcing portion of each of said fastening arms along an inner circumference of said mounting hole, and bending a free end portion of each of said fastening arms to rest on said bottom side of said sheet stack.

10. The method, as recited in claim 1, wherein said fastening arms are integrally extended from said binding body to form a one piece structure, wherein said binding body is made of metal piece.

11. The method, as recited in claim 1, wherein said binding body and said fastening arms are made of an elongated metal wire bent in a U-shape to form a longitudinal U-shaped wire portion as said second binding portion of said binding body, two transverse U-shaped wire portions as said first binding portion of said binding body, and two free ends as said two fastening arms respectively.

12. The method, as recited in claim 11, wherein the step (c) further comprises a step of aligning said mounting hole between two guiding edges of said guiding slot such that when said fastening arms are extended through said guiding slot, said fastening arms are bent at said guiding edges respective for resting on said bottom side of said stack sheet.

13. The method, as recited in claim 12, wherein said guiding slot has a first opened end extended to said first binding portion of said binding body and a second closed end extended to said second binding portion of said binding body that said guiding edges are extended from said first opened end to said second closed end.

14. The method, as recited in claim 13, wherein each of said fastening arms has a root portion extended from said binding body, a free end portion, and a reinforcing portion defining between said root portion and said free end portion, wherein the step (a) further comprises the steps of extending a reinforcing portion of each of said fastening arms along an inner circumference of said mounting hole, and bending a free end portion of each of said fastening arms to rest on said bottom side of said sheet stack.

15. The method, as recited in claim 10, further comprising a plastic tubular sleeve encirclingly enclosing said metal wire.

16. The method, as recited in claim 1, wherein said binding body and said fastening arms are made of an elongated metal wire bent in a U-shape that a U-shaped end portion of said metal wire is formed as said second binding portion of said binding body, a mid-portion of said metal wire is formed as said first binding portion of said binding body, and two free ends are formed as said two fastening arms respectively.

17. The method, as recited in claim 16, wherein the step (c) further comprises a step of aligning said mounting hole between two guiding edges of said guiding slot such that when said fastening arms are extended through said guiding slot, said fastening arms are bent at said guiding edges respective for resting on said bottom side of said stack sheet.

18. The method, as recited in claim 17, wherein said guiding slot has a first opened end extended to said first binding portion of said binding body and a second closed end extended to said second binding portion of said binding body that said guiding edges are extended from said first opened end to said second closed end.

19. The method, as recited in claim 18, wherein each of said fastening arms has a root portion extended from said binding body, a free end portion, and a reinforcing portion defining between said root portion and said free end portion, wherein the step (a) further comprises the steps of extending a reinforcing portion of each of said fastening arms along an inner circumference of said mounting hole, and bending a free end portion of each of said fastening arms to rest on said bottom side of said sheet stack.

20. The method, as recited in claim 16, further comprising a plastic tubular sleeve encirclingly enclosing said metal wire.

* * * * *